US006834515B2

(12) United States Patent
Sunder et al.

(10) Patent No.: US 6,834,515 B2
(45) Date of Patent: Dec. 28, 2004

(54) PLATE-FIN EXCHANGERS WITH TEXTURED SURFACES

(75) Inventors: Swaminathan Sunder, Allentown, PA (US); Patrick Alan Houghton, Emmaus, PA (US); Vladimir Vasilievich Kuznetsov, Novosibirsk (RU)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/243,149

(22) Filed: Sep. 13, 2002

(65) Prior Publication Data

US 2004/0050538 A1 Mar. 18, 2004

(51) Int. Cl.[7] ..... F25J 3/00; F25J 5/00; F28F 13/18; F28F 19/02

(52) U.S. Cl. ..... 62/643; 62/903; 165/133

(58) Field of Search ..... 62/643, 903; 165/133

(56) References Cited

U.S. PATENT DOCUMENTS

| | | | | | |
|---|---|---|---|---|---|
| 2,937,010 | A | * | 5/1960 | Collman et al. | 165/10 |
| 3,684,007 | A | * | 8/1972 | Ragi | 165/133 |
| 4,011,905 | A | * | 3/1977 | Millard | 165/175 |
| 4,296,050 | A | | 10/1981 | Meier | 261/112 |
| 4,380,907 | A | * | 4/1983 | Barnes et al. | 62/50.2 |
| 4,434,842 | A | * | 3/1984 | Gregory | 165/133 |
| 4,715,431 | A | * | 12/1987 | Schwarz et al. | 165/110 |
| 4,715,433 | A | * | 12/1987 | Schwarz et al. | 165/110 |
| 5,514,248 | A | * | 5/1996 | Okuda et al. | 159/28.6 |
| 5,709,264 | A | * | 1/1998 | Sweeney et al. | 165/115 |
| 5,722,258 | A | * | 3/1998 | Aitken | 62/643 |
| 5,730,000 | A | | 3/1998 | Sunder et al. | 62/643 |
| 5,868,199 | A | * | 2/1999 | Lavin | 165/166 |
| 5,876,638 | A | | 3/1999 | Sunder et al. | 261/112.2 |
| 5,934,128 | A | * | 8/1999 | Takiura et al. | 72/197 |
| 5,966,809 | A | | 10/1999 | Pierce | 29/890.047 |
| 6,012,514 | A | | 1/2000 | Swain | 165/154 |
| 6,186,222 | B1 | * | 2/2001 | Doko et al. | 165/133 |
| 6,338,384 | B1 | * | 1/2002 | Sakaue et al. | 165/166 |
| 6,360,561 | B2 | * | 3/2002 | Allam et al. | 62/654 |
| 6,461,583 | B1 | * | 10/2002 | Hayashida et al. | 423/579 |
| 2001/0047862 | A1 | * | 12/2001 | Anderson et al. | 165/170 |

FOREIGN PATENT DOCUMENTS

JP 409155487 A * 6/1997

OTHER PUBLICATIONS

Reay, D.A., "Heat transfer enhancement—review of techniques and their possible impact on energy efficiency in the UK", *Heat Recovery System and CHP vol. 11*, No. 1, p. 1–40, 1991.

* cited by examiner

*Primary Examiner*—William C. Doerrler
(74) *Attorney, Agent, or Firm*—Willard Jones, II

(57) ABSTRACT

In a plate-fin exchanger having a plurality of fins disposed between neighboring parting sheets, at least a portion of at least one of the fins has a textured surface. The textured surface is in the form of grooves or fluting formed on or applied to the surface of the fin material used in the plate-fin exchanger.

16 Claims, 7 Drawing Sheets

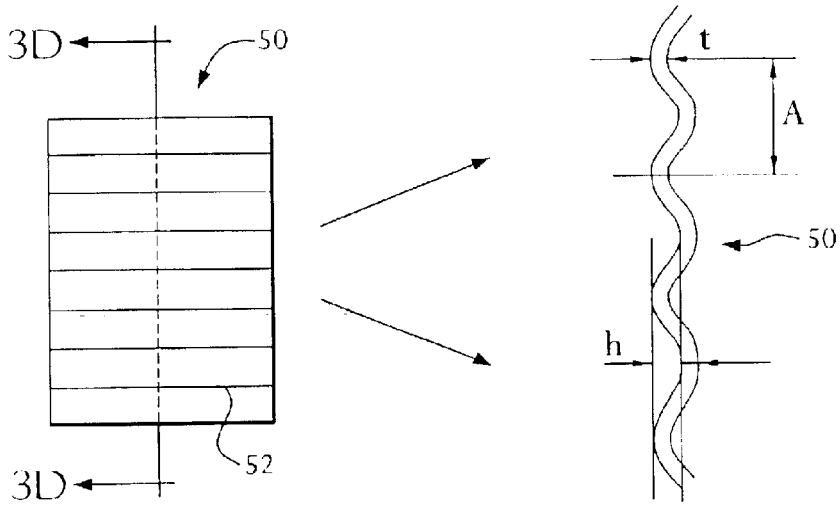
FIG. 3A
FIG. 3D
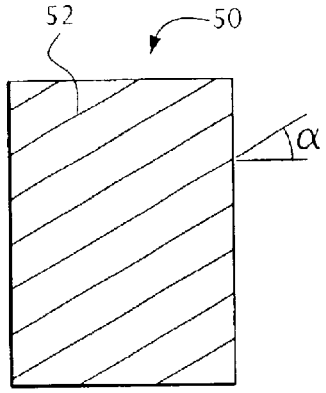
FIG. 3B
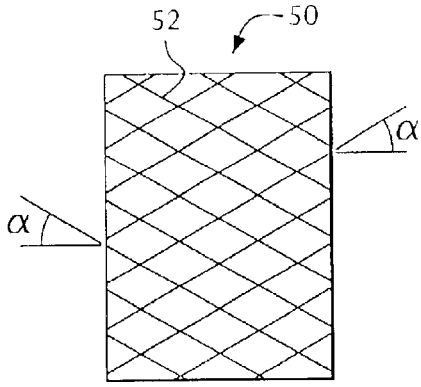
FIG. 3C

PLATE-FIN EXCHANGERS WITH TEXTURED SURFACES

BACKGROUND OF THE INVENTION

The present invention relates to plate-fin exchangers having textured surfaces and to methods for assembling such plate-fin exchangers. The plate-fin exchangers having fins with textured surfaces according to the present invention have particular application in cryogenic processes such as air separation, although these plate-fin exchangers also may be used in other heat and/or mass transfer processes.

Plate-fin exchangers are generally used for exchanging heat between process streams for the purpose of heating, cooling, boiling, evaporating, or condensing the streams. In this case they may be referred to more particularly as plate-fin heat exchangers. The process conditions in these heat exchangers may involve single phase or two phase heat transfer, wherein the fluid streams flow in a generally upward direction or in a generally downward direction (although the flows may also be in other directions). But in some cases the process streams include mixtures of components so that mass transfer separation also is carried out in addition to heat transfer. In the latter case, vapor and liquid flow in countercurrent directions within a stream passage and the heat/mass exchanger may be referred to as a dephlegmator.

It is known from the prior art that there are several ways to enhance the performance of heat exchangers. See, for example, D. A. Reay, "Heat transfer enhancement—review of techniques and their possible impact on energy efficiency in the UK," Heat Recovery System & CHP vol. 11, No. 1, p. 1–40, 1991; Some of the techniques known in the prior art include:

- the surfaces of some heat exchangers can be roughened to improve the heat transfer performance in single phase flow by promoting turbulence in the boundary layer;
- the surfaces of some heat exchangers can be treated with special coatings or modified geometrically to create reentrant cavities which can improve the performance in nucleate boiling;
- the surfaces of some heat exchangers can be treated or modified geometrically in order to alter wetting by liquids which can improve the performance by promoting drop-wise condensation or facilitating drainage of the condensate; and
- while all of the above techniques are applicable to plate-fin heat exchangers, their performance is most readily improved by the use of perforated, serrated or wavy fins which increase the turbulence relative to plain fins.

However, as persons skilled in the art will recognize, each of the prior art techniques are limited in one or more ways. For example, the improvements obtainable may be limited to single flow applications, to a narrow range of flow and operating conditions, or to a single mode, such as condensation.

An example of the surfaces of a plate-fin heat exchanger being modified is disclosed in U.S. Pat. No. 4,434,842 (Gregory). In this heat exchanger, fins in the boiling regions are made of at least two layers, with at least one of the outer layers having a plurality of holes therein. The corrugated sheets of the fins are in close proximity one to the other such that nucleation of bubbles occurs between the sheets and the bubbles are released by the holes in the sheets.

Although Applicants are not aware of any prior art plate-fin heat exchangers in which the fins have a surface texture in the form of grooves or fluting (such as that used in the present invention), such surface texture has been used on other types of heat exchangers (e.g., shell and tube exchangers) to create or enhance turbulence and improve heat transfer. For example, see U.S. Pat. Nos. 4,434,842; 6,012,514; and 5,966,809. However, in addition to the fact that those patents do not pertain to plate-fin heat exchangers, the teachings of those patents are not pertinent to the teachings of the present invention.

In the field of contact processes which use structured packing, it is well known that surface texture in the form of fluting or grooves can improve mass transfer efficiency, as taught in U.S. Pat. No. 4,296,050. See also U.S. Pat. Nos. 5,730,000 and 5,876,638. These patents teach the use of a bidirectional surface texture in the form of fine grooves applied in patches on the surface of corrugated plates of a packing element such that the texture is substantially horizontal in some regions and substantially vertical in other regions. But this improvement is based on the experience in a specific operating mode, namely downwardly flowing liquid film undergoing mass transfer against vapor which flows upward in a direction countercurrent to the liquid flow. The present invention has a much broader scope and range of applications than that. Also, the overall geometry and flow characteristics within a plate-fin exchanger are very different from those of a structured packing even for generally similar operating modes.

It is desired to increase the efficiency and improve the performance of plate-fin exchangers.

It is further desired to improve the wetting characteristics of a downwardly flowing vapor-liquid stream within the passages of a plate-fin exchanger in order to improve the heat transfer efficiency.

It is still further desired to improve the flow characteristics of an upwardly flowing vapor-liquid stream within the passages of a plate-fin exchanger in order to improve the heat transfer efficiency.

It is still further desired to improve the turbulence characteristics of a single phase stream within the passages of a plate-fin exchanger in order to improve the heat transfer efficiency.

It is still further desired to improve the turbulence characteristics within the flow passages of a counter-current dephlegmator in order to improve the mass transfer efficiency relative to a conventional plate-fin exchanger employed under similar operating conditions.

It is still further desired to improve the wetting characteristics of a downwardly flowing vapor-liquid stream within the passages of a plate-fin exchanger such that the tendency to precipitate out any dissolved components is minimized.

It is still further desired to have a plate-fin exchanger or dephlegmator that shows high performance characteristics for cryogenic applications, such as those used in air separation, and for other heat and/or mass transfer applications.

It is still further desired to have a plate-fin exchanger which overcomes many of the difficulties and disadvantages of the prior art to provide better and more advantageous results.

It is still further desired to have a more efficient air separation process utilizing a plate-fin exchanger or downflow reboiler which is more compact and/or more efficient than the prior art.

It is still further desired to have a plate-fin exchanger design which minimizes the size, weight and/or cost of downflow reboilers, which would result in an air separation process more efficient and/or less expensive per unit quantity of product produced.

It also is further desired to have a method for assembling a plate-fin exchanger or a downflow reboiler which uses fins having a surface texture thereon which affords better performance than the prior art, and which also overcomes many of the difficulties and disadvantages of the prior art to provide better and more advantageous results.

BRIEF SUMMARY OF THE INVENTION

The present invention is a plate-fin exchanger having textured surfaces. The invention also provides a method for assembling such a plate-fin exchanger, and a method for improving the performance of a plate-fin exchanger. The "textured surface" used in the present invention to obtain a "surface texture" is in the form of grooves or fluting formed on or applied to the surface of the fin material used in the plate-fin exchanger.

A first embodiment of the invention is a plate-fin exchanger having a plurality of fins disposed between neighboring parting sheets, at least a portion of at least one of the fins having a textured surface.

A second embodiment is a plate-fin exchanger comprising an assembly of a plurality of substantially parallel parting sheets and a plurality of corrugated fins disposed between adjacent parting sheets, each of the fins having at least one surface, wherein at least a portion of the at least one surface of at least one fin is textured.

A third embodiment is a plate-fin exchanger which includes a first parting sheet and a second parting sheet adjacent and substantially parallel to the first parting sheet. At least one corrugated fin is disposed between the first parting sheet and the second parting sheet, the fin having at least one surface, wherein a surface texture is applied on at least a portion of the surface.

There are several variations of the third embodiment of the plate-fin exchanger. In one variation, at least a portion of the surface texture is in the form of horizontal striations. In another variation, at least a portion of the surface texture is applied at an angle relative to a horizontal position. In a variant of that variation, the angle is greater than about 0° degrees and less than about 75° degrees. In another variant, the angle is greater than about 0° and less than about 50°.

In another variation, at least a portion of the surface texture is applied in a crisscrossing manner. In yet another variation, the surface texture is in the form of a groove having a wavelength and a range of about 0.5 mm to about 5 mm. In a variant of that variation, the groove is at an angle relative to a horizontal position, the angle being greater than about 0° and less than about 75°.

In another variation, the surface texture is in the form of a groove having a wavelength in a range of about 1 mm to about 3 mm. In yet another variation, the surface texture is in the form of a groove having an amplitude in a range of about 0.05 mm to about 0.75 mm. In a variant of that variation, the groove is at an angle relative to a horizontal position, the angle being greater than about 0° and less than about 75°.

In another variation, the surface texture is in the form of a groove having an amplitude in range of about 0.05 mm to about 0.75 mm. In a variant of that variation, the groove is at an angle relative to a horizontal position, the angle being greater than about 0° and less than about 75°.

In another variation, the surface texture is in the form of a groove having an amplitude in a range of about 0.15 mm to about 0.50 mm. In yet another variation, the surface texture is in the form of a groove having a wavelength in a range of about 0.5 mm to about 5 mm and an amplitude in range of about 0.05 mm to about 0.75 mm. In a variant of that variation, the groove is at an angle relative to a horizontal position, the angle being greater than about 0° and less than about 75°.

Another aspect of the present invention is a cryogenic air separation unit having a plate-fin exchanger as in any of the above described embodiments or variations of those embodiments.

A fourth embodiment of the invention is an improvement to a plate-fin exchanger having at least one corrugated fin disposed between neighboring parting sheets. The improvement is a surface texture applied on at least a portion of the at least one surface.

A fifth embodiment of the invention is a plate-fin heat exchanger for indirect heat exchange of a plurality of fluid streams having a first group of passages adapted to carry a first fluid stream, the first fluid stream being two-phase in at least a portion of the first group of passages, the portion of the first group of passages having a plurality of fins disposed therein, at least one of the fins being disposed between neighboring parting sheets and having a textured surface.

A sixth embodiment is a plate-fin heat exchanger for reboiler or condenser service, the heat exchanger comprising a parallelepipedal body including an assembly of a plurality of substantially parallel parting sheets and a plurality of corrugated fins disposed between adjacent parting sheets, at least one of the fins being disposed between neighboring parting sheets and having a textured surface.

A seventh embodiment is a downflow reboiler having a generally parallelepipedal body formed by an assembly of substantially parallel vertically extending passages adapted to receive a first fluid introduced into a first group of passages and a second fluid introduced into a second group of passages, the passages in the second group of passages alternating in position with the passages in the first group of passages, the first group of passages having a plurality of fins disposed between neighboring parting sheets, the fins including hardway fins for fluid distribution of the first fluid and easyway heat transfer fins downstream of the hardway fins, the heat transfer fins forming one or more heat transfer sections with progressively decreasing surface area, at least one heat transfer fin in a first heat transfer section having at least one surface, the improvement comprising a surface texture applied on at least one surface.

Another aspect of the present invention is a downflow reboiler according to the seventh embodiment installed in a column of an air separation plant wherein a liquid oxygen-containing stream is passed through the first group of passages in parallel flow to a nitrogen-containing and/or argon-containing stream in the second group of passages.

An eighth embodiment of the invention is an improvement to a downflow reboiler having a generally parallelepipedal body formed by an assembly of substantially parallel vertically extending passages adapted to receive a first fluid introduced into a first group of passages and a second fluid introduced into a second group of passages, the passages in the second group of passages alternating in position with the passages in the first group of passages, the second group of passages having a plurality of fins disposed between neighboring parting sheets, the fins including inlet and outlet distribution fins for uniform flow of the second fluid into and out of the second group of passages and heat transfer fins forming at least one heat transfer section between the inlet and outlet distribution fins, at least one heat transfer fin in the at least one heat transfer section having at least one surface, the improvement comprising a surface texture applied on the at least one surface.

Another aspect of the invention is a downflow reboiler according to the eighth embodiment installed in a column of an air separation plant wherein a liquid oxygen-containing stream is passed through the first group of passages in parallel flow to a nitrogen-containing and/or argon-containing stream in a second group of passages.

A ninth embodiment is a plate-fin exchanger for dephlegmator service, the exchanger comprising a parallelepipedal body including an assembly of a plurality of substantially parallel parting sheets and a plurality of corrugated fins disposed between adjacent parting sheets, at least one of said fins being disposed between neighboring parting sheets and having a textured surface.

The present invention also includes a method for assembling a plate-fin exchanger. The method includes multiple steps. The first step is to provide two substantially parallel parting sheets and an elongated sheet. The second step is to form a surface texture on the elongated sheet. The third step is to corrugate the elongated sheet to form a fin having the surface texture thereon. The fourth step is to dispose the fin having the surface texture thereon between the parting sheets.

In a variation of the method for assembling a plate-fin exchanger, at least a portion of the surface texture is in the form of at least one groove having a wavelength in a range of about 0.5 mm to about 5 mm and an amplitude in a range of about 0.05 mm to about 0.75 mm, the at least one groove being at an angle relative to a horizontal position, the angle being greater than about 0° and less than about 75°.

The present invention also includes a method for improving the performance of a plate-fin exchanger having at least one fin between neighboring parting sheets, comprising applying a surface texture on at least a portion of the at least one fin.

BRIEF DESCRIPTION OF SEVERAL VIEWS OF THE DRAWINGS

The invention will now be described by way of example with reference to the accompanying drawings, in which:

FIG. 3A is a schematic diagram illustrating a textured surface having horizontal striations according to the present invention;

FIG. 3B is a schematic diagram of another textured surface using striations at an angle ($\alpha$) to the horizontal;

FIG. 3C is a schematic diagram illustrating another textured surface using striations applied in a crisscrossing manner;

FIG. 3D is a schematic diagram illustrating a sectional view of the textured surface in FIG. 3A taken along line 3D-3D;

DETAILED DESCRIPTION OF THE INVENTION

The present invention uses textured surfaces in plate-fin exchangers for improved heat and mass transfer. Specifically, the "textured surface" used in the present invention to obtain a "surface texture" is in the form of grooves or fluting formed on or applied to the surface of the fin material used in a plate-fin exchanger.

Textured surfaces may be applied to plain, perforated, wavy, serrated or other fin types. Texture is most easily formed by pressing the metal stock with fluting or grooves prior to finning. The fluting may be horizontal, sloping in one direction, or sloping in different directions, including in a crisscrossing arrangement. Textured plate-fin heat exchangers may be used to process streams in a variety of operating conditions involving heating, cooling, boiling, evaporation, or condensation, and flow conditions including single phase, two phase, upward flow, or downward flow. The present invention also may be used to process streams which are undergoing separation by mass transfer in addition to heat transfer.

Persons skilled in the art would not expect any single enhancement technique to improve heat and/or mass transfer efficiency in multiple modes of operation. Thus, it is a surprising and unexpected result of the present invention that the addition of surface texture to fin material does improve heat and/or mass transfer efficiency in multiple modes of operation, as indicated above.

Figure 1A:
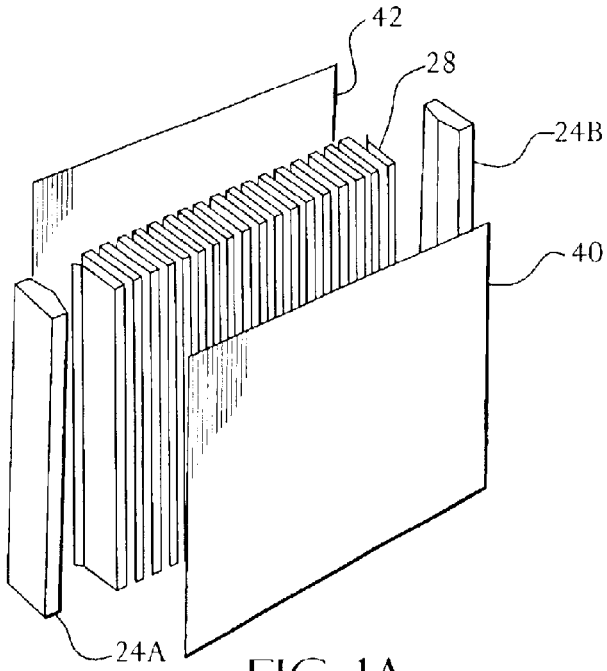
FIG. 1A (PRIOR ART)
FIG. 1A is an exploded perspective view of a basic element or sub-assembly of a conventional plate-fin exchanger.

Referring to FIG. 1, a conventional plate-fin exchanger comprises several passages, each of which is made with fin material 28 placed between parting sheets (40, 42) and end bars (24A, 24B). The most common fin types are plain, perforated, serrated, and wavy as shown in FIGS. 2A, 2B, 2C and 2D.

Figure 1B:
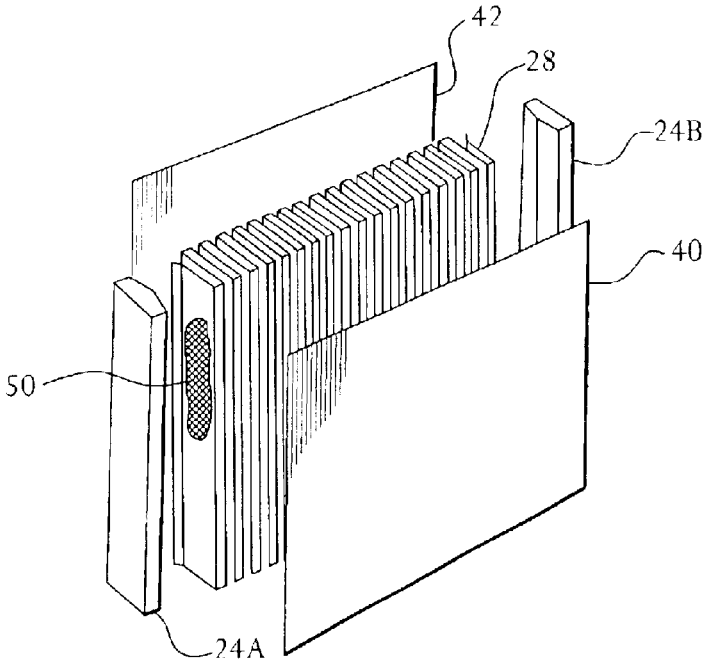
FIG. 1B is an exploded perspective view of a basic element or sub-assembly of a plate-fin exchanger with fins having a textured surface according to the present invention.
Figure 2A:
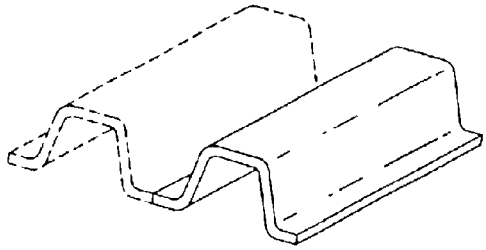
FIG. 2A (PRIOR ART)
FIGS. 2A–2D illustrate four types of fins typically used in plate-fin exchangers.
Figure 2B:
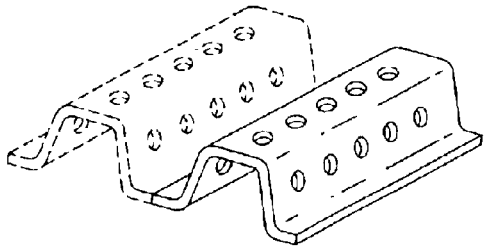
FIG. 2B (PRIOR ART)
Figure 2C:
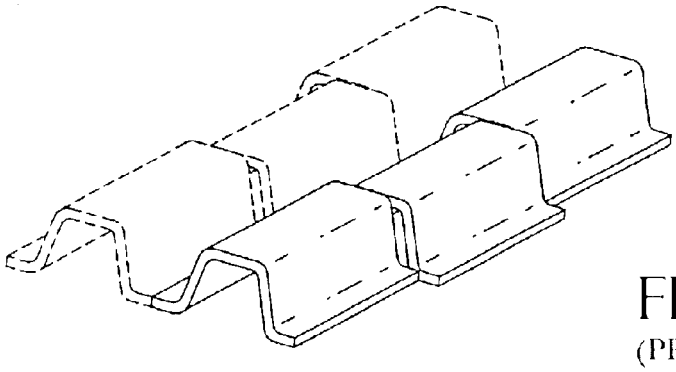
FIG. 2C (PRIOR ART)
Figure 2D:
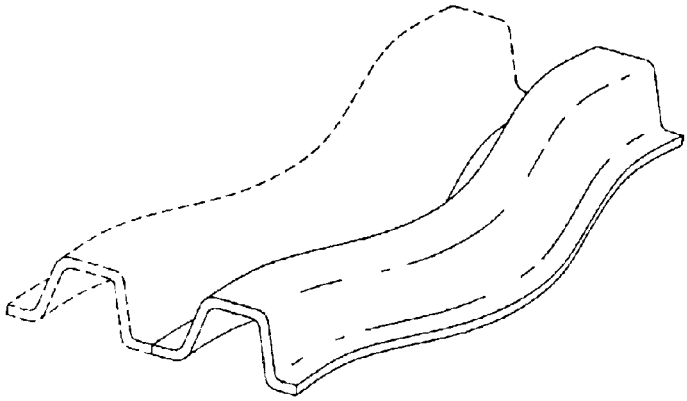
FIG. 2D (PRIOR ART)

As shown in FIG. 1B, the present invention uses fins having a textured surface 50 in the place of conventional fins. FIGS. 3A, 3B, 3C and 3D show some examples of the types of textured surfaces 50 that may be used. Although the striations formed by the grooves or fluting are preferably in the form of straight lines that generally are uniformly straight (prior to corrugating the sheet), persons skilled in the art will recognize that the striations need not be straight. For example, each striation could be curved, zigzag, or some other shape. Also, although the lines 52 in FIGS. 3A, 3B and 3C are uninterrupted and substantially parallel to form a uniform pattern, persons skilled in the art will recognize that the lines of the grooves or fluting may be interrupted and may form other patterns, both uniform and non-uniform.

While not wanting to be limited to any particular manufacturing method, it is most advantageous to apply the surface texture to a flat metal sheet stock by an operation such as pressing, just prior to the metal being formed into a fin shape. For instance, to apply the surface texture of the present invention to a perforated fin, the following procedure may be used:

perforate a flat metal sheet stock;

apply the surface texture by an operation such as pressing;

form the perforated fin without damaging the surface texture in the process (which may require the use of special tooling); and braze the fin into a plate-fin exchanger.

The procedure to apply the invention to other types of fins (i.e., other than a perforated fin) would require similar steps but the exact sequence of the operations may be different, as persons skilled in the art will recognize.

The surface textures shown in FIGS. 3A, 3B and 3C may consist of grooves or fluting 52 which are nearly sinusoidal in a sectional view, as shown in FIG. 3D. Persons skilled in the art will recognize that other possible shapes include, but are not limited to, a wavy undulating shape, sharp waves, a saw-tooth or a square wave shape. Applicants have determined that the following ranges of dimensions are optimal:

the wavelength A (shown in FIG. 3D) is preferably in a range of about 0.5 mm to about 5 mm, with a most preferred range of about 1 mm to about 3 mm; and the peak to peak amplitude h (shown in FIG. 3D), when viewed on only one side of the sheet, is preferably in the range of about 0.05 mm to about 0.75 mm, with a most preferred range of about 0.15 mm to about 0.50 mm. The choice of this dimension (h) may be limited by the physical spacing between adjacent fins and/or the metal thickness (t) (illustrated in FIG. 3D). A very tight spacing between adjacent fins, a high metal thickness, or both, will restrict the depth of the grooves or fluting that may be used.

In the cases of sloping texture (FIG. 3B) and crisscrossing texture (FIG. 3C) the angle $\alpha$ of the fluting relative to the horizontal is preferably in the range of about 0 degrees to about 75 degrees, and most preferably in the range of about 0 degrees to about 50 degrees. Although FIG. 3C shows equal angles ($\alpha=\alpha$) on both sides of the diagram, persons skilled in the art will recognize that the angles need not be the same (i.e., the angle on one side could be $\alpha$ and the other angle on the other side could be greater than or less than $\alpha$).

While the teachings of the prior art in terms of enhancements to surfaces will lead to different embodiments as applicable to different flow conditions and geometries, Applicants were surprised to find that surface texture in the form of fluting or grooves can enhance the performance of a plate-fin heat exchanger in all operating modes, including single phase or two phase flow, upward flow or downward flow, heating or cooling, and evaporation or condensation. This unexpected result would also be surprising to other persons skilled in the art.

The present invention has significant value because plate-fin exchangers can be made more compact relative to conventional plate-fin exchangers by the use of surface texture on the fin material. This can be beneficial in terms of the combined capital and operating cost of a plant, such as an air separation plant. The present invention also may reduce fouling in streams that evaporate in downward flow. In cryogenic air separation this would be particularly valuable with downflow reboilers which evaporate oxygen-containing streams.

EXAMPLES

The examples discussed below are provided to illustrate possible uses of the present invention. Other examples can be envisioned by persons skilled in the art.

Example 1

Figure 4:
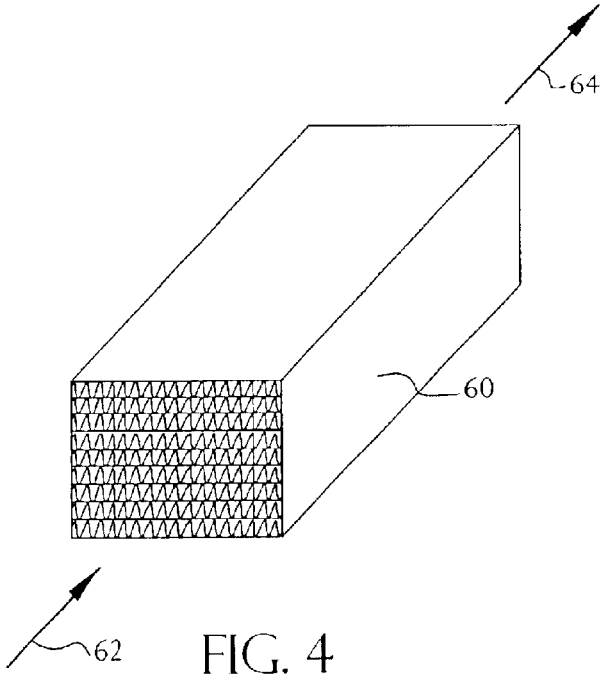
FIG. 4 is a schematic diagram illustrating an experimental sample made of a horizontal stack of fin passages.

This example illustrates the enhancement of single-phase flow heat transfer obtained by the application of surface texture according to the teachings of the present invention. The comparisons in this example are relative to perforated fins and plain fins commonly used in plate-fin heat exchangers. FIG. 4 is a schematic diagram of the experimental samples, and FIG. 5 shows the performance comparisons.

As shown in FIG. 4, the experimental samples were made out of a horizontal stack 60 of nine fin passages, which were approximately 80 mm wide and 280 mm long. All samples contained 22 fins per inch with an equivalent diameter of about 1.65 mm. This value was calculated using the well-known formula of four times the volume enclosed by the fins divided by their base surface area excluding the effects of perforations or texture. The perforated samples had an open area of about 10%. The sheet thickness t for all samples was 0.2 mm. When surface texture was used, it was roughly sinusoidal with an amplitude h equal to 0.2 mm and a wavelength A equal to 1.75 mm according to the schematic diagram of FIG. 3D. Two different surface texture inclinations were studied with the angles noted in the legend of FIG. 5. The value of 90 denotes a surface texture direction which is perpendicular to the fin direction, while the value of 45 denotes a surface texture direction which is sloping (at 45°) relative to the fin.

Experiments were performed on the test sections inside a wind tunnel. First, the samples were brought to a steady operating condition in flowing air. Then an abrupt step-change was made to the temperature of the incoming air 62 following which the outlet response 64 was measured as a heat pulse image. The heat transfer coefficient was calculated based on the maximum outlet temperature gradient according to Locke's procedure [Locke, G. L., 1950, Heat Transfer and Flow Friction Characteristic of Porous Solid, Tr. No. 10, Mech. Eng. Dept., Stanford University, Stanford, Calif.]. The pressure drop was measured with an inclined U-tube manometer. The frictional pressure drop was calculated after accounting for entrance and exit effects due to flow acceleration according to the methods in Kays, W. M and London, A. L., 1984, Compact Heat Exchangers, 3rd Ed., McGraw-Hill, N.Y.

Figure 5:
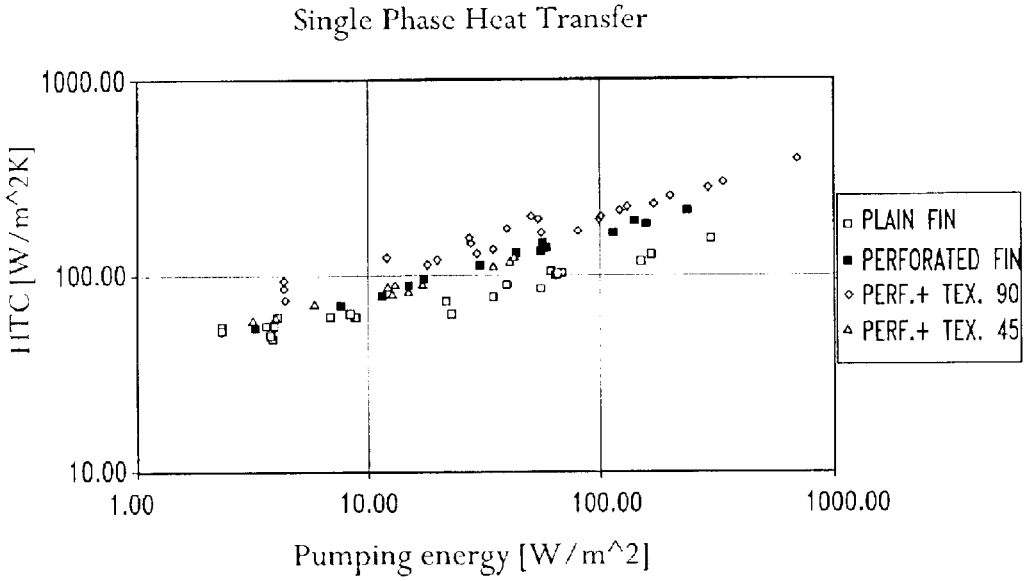
FIG. 5 is a graph illustrating the performance of the textured fins according to the present invention in comparison to plain and perforated prior art fins in terms of heat transfer co-efficients versus pumping energy for single phase heat transfer.

FIG. 5 shows a plot of heat transfer coefficients versus pumping energy. In such a plot a higher curve is equivalent to superior performance. It can be seen that perforated fins are superior to plain fins, as is well known in the prior art. The addition of sloping surface texture (45) does not improve the performance of the perforated fin. However, the addition of perpendicular surface texture (90) produces a 30–50% improvement in heat transfer coefficients at the same pumping energy. (Note that this plot uses logarithmic scales.) These results were surprising and unexpected to Applicants, both in qualitative and quantitative terms, and would be surprising and unexpected to other persons skilled in the art.

Example 2

This example illustrates the enhancement of two-phase flow heat transfer under a variety of conditions obtained by the application of surface texture according to the teachings of the present invention. The comparisons in this example are relative to perforated fins, which are commonly used for two-phase flow service in plate-fin heat exchangers.

Figure 6:
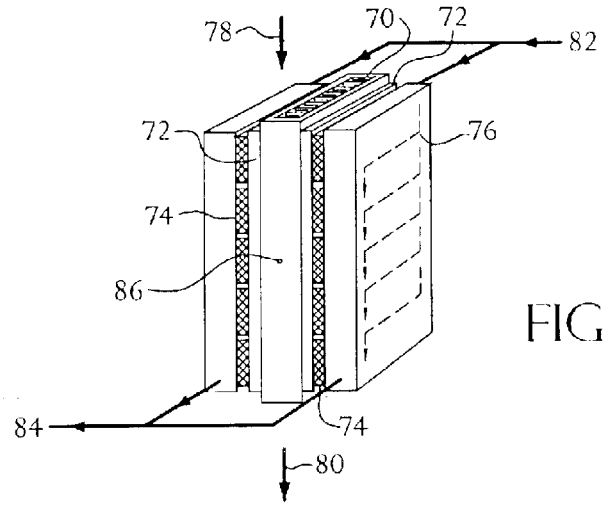
FIG. 6 is a schematic diagram illustrating a test set up used to determine the performance of prior art fins and fins having textured surfaces according to the present invention.

FIG. 6 is a schematic diagram of the test set up, and FIGS. 7–14 show the performance comparisons. The orientation of the fin test passages was vertical in all cases, and when surface texture was used it was in a direction that was perpendicular to the fin direction. In other words, the surface texture direction was horizontal relative to the laboratory, which corresponds to an angle $\alpha$ of 0 degrees according to the schematic diagram in FIG. 3A.

As shown in FIG. 6, each test sample 70 was made out of one fin passage brazed between aluminum cap sheets. The sample was open at the top and bottom and closed at the sides in order to contain the fluid flow in the vertical direction. Each passage was approximately 70 mm wide and 280 mm long and held in a sandwich-like fashion between high thermal conductivity mastic, copper plates 72, Peltier junctions 74, and water flow passages 76 on both sides. Peltier junctions were used to fix the temperature driving forces in such a way that heat transfer coefficients could be measured with high accuracy even from such small samples.

Incoming flows of vapor/liquid entered at the vapor-liquid inlet 78, and outgoing flows exited at the vapor-liquid outlet 80. Cooling water entered at the cooling water inlet 82, and exited at the cooling water outlet 84. Pressures were measured by pressure probe 86.

Experiments were performed using freon 21 in a variety of modes including evaporation and condensation at two different mass fluxes under upward flow and downward flow conditions. Because of the small size of the samples, in any given experiment only a small change occurred in the quality, which represents the portion of the total two-phase mixture that is in the vapor phase. Experiments were repeated a number of times in order to map a wide range of interest.

As seen in FIGS. 7–14, the perforated plus textured fin sample shows a performance that is consistently superior to that of the perforated fin sample. This effect can be seen under all operating conditions in all of the figures. Although the magnitudes are different at different conditions, the improvement pattern is a general phenomenon with the addition of surface texture. Generally, the improvement ranges from about 10% to about 50%.

Figure 7:
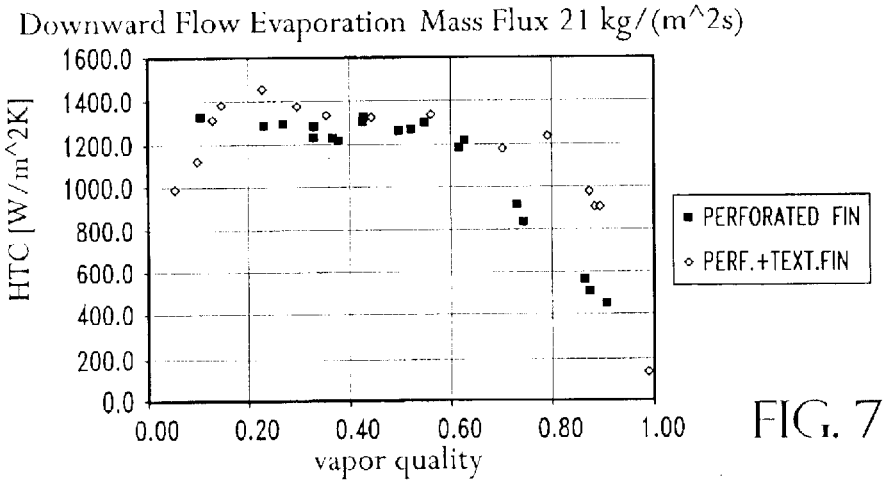
FIGS. 7–14 are graphs illustrating the performance of fins having textured surfaces according to the present invention in comparison to the performance of prior art fins in terms of vapor quality versus heat transfer co-efficients under the conditions noted above each of the graphs.
Figure 8:
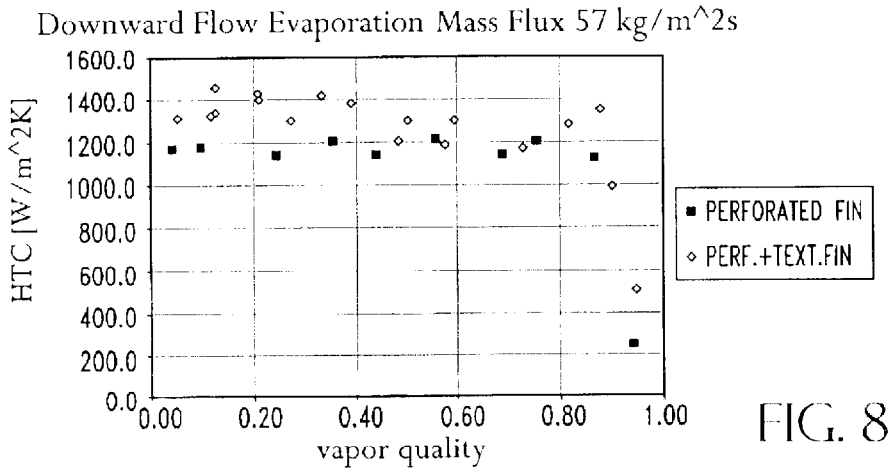
Figure 9:
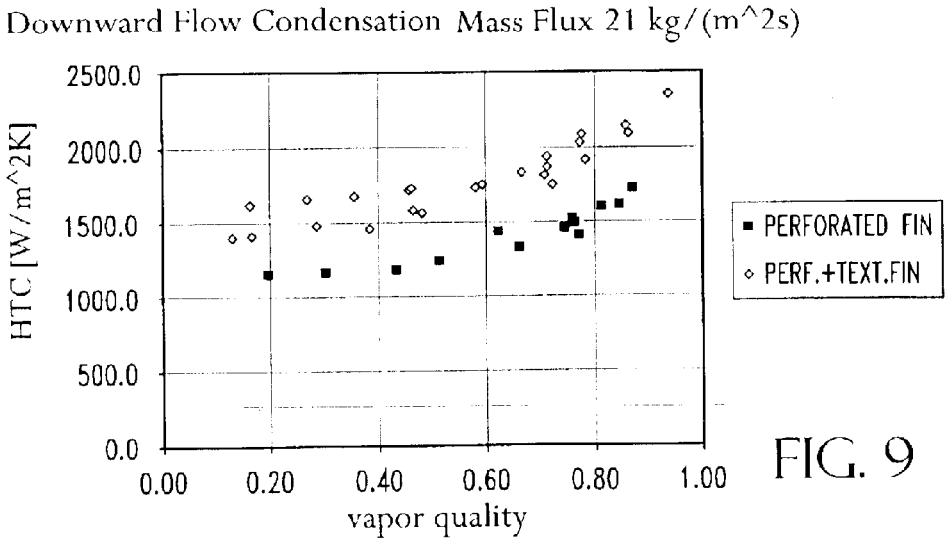
Figure 10:
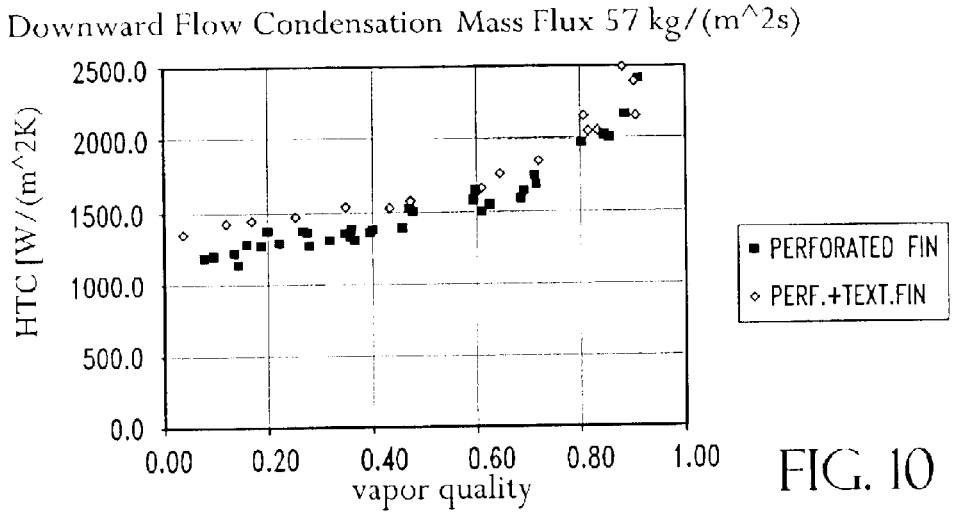
Figure 11:
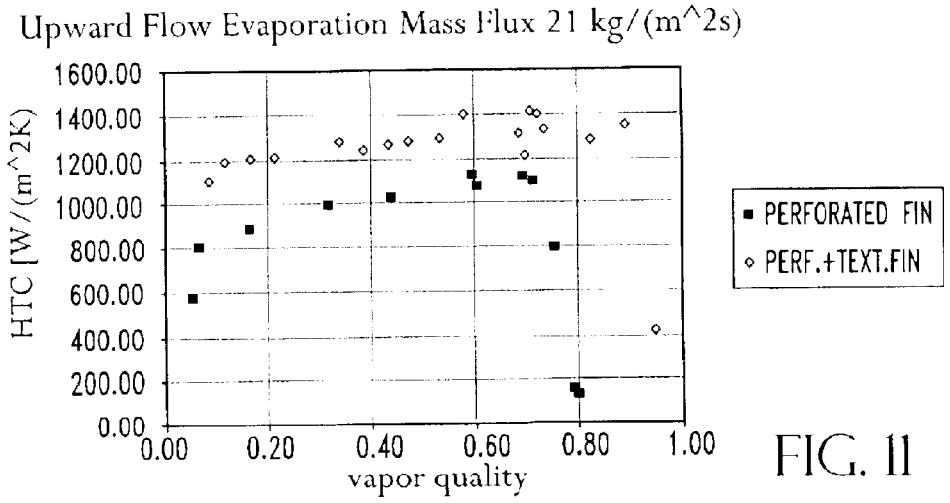
Figure 12:
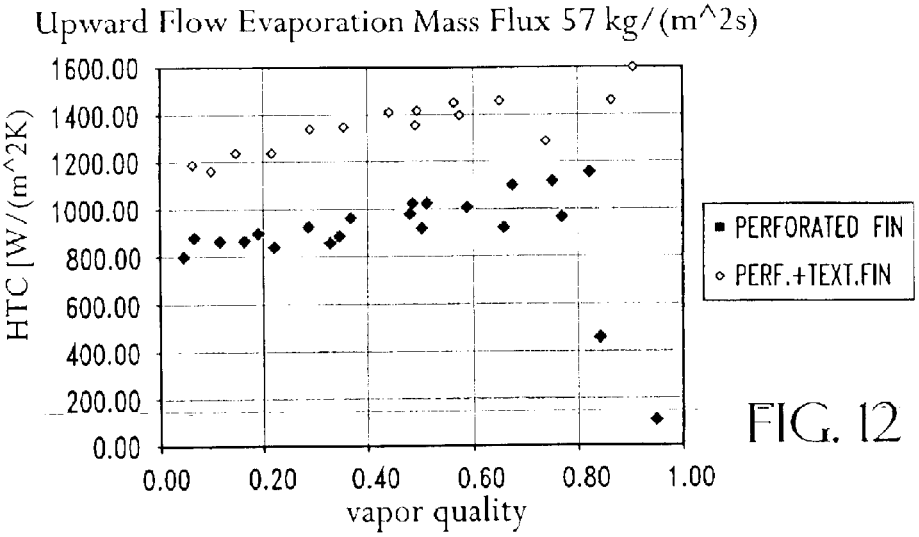
Figure 13:
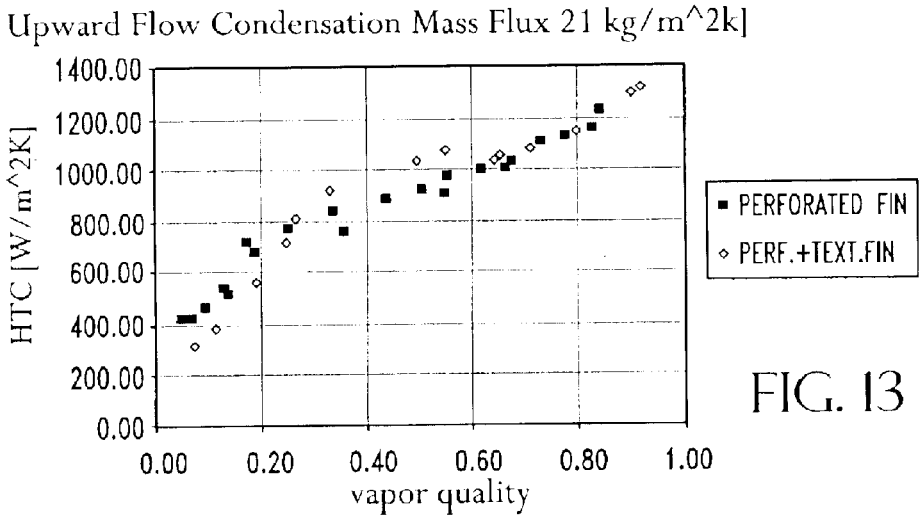
Figure 14:
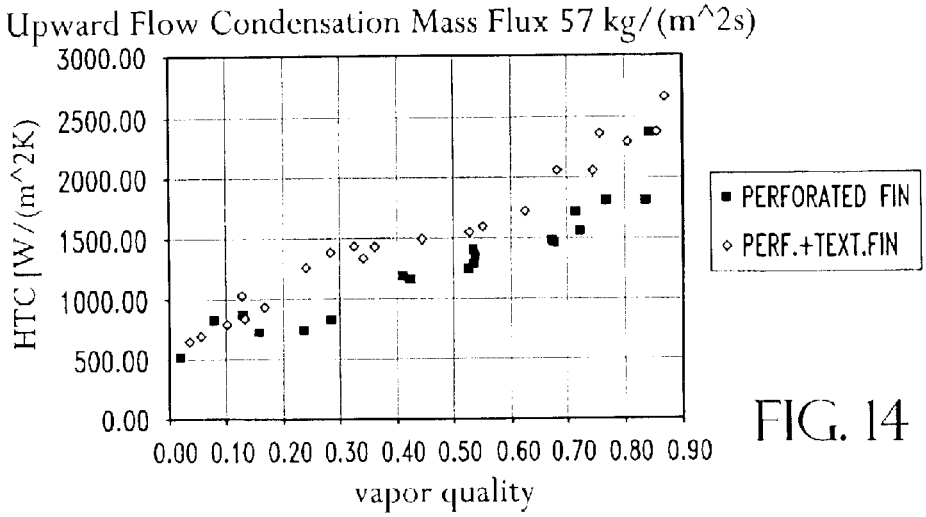

Another interesting effect occurs only in evaporation. It is a phenomenon known as dry-out, wherein heat transfer degradation occurs at very high vapor qualities as a result of the heat transfer surfaces beginning to dry out. This does not occur in condensation. As shown in FIGS. 7 and 8 for downflow evaporation and FIGS. 11 and 12 for upflow evaporation, the perforated plus textured fin maintains better heat transfer coefficients at high vapor qualities when compared to the perforated fin. This is an indication that the surface texture of Example 2 has beneficial effects on the wetting characteristics of perforated fins.

In addition to improving heat transfer, better wetting characteristics also can provide a very important secondary benefit, which is a reduction in the fouling tendency. Reboiler condensers used in industrial air separation plants evaporate oxygen-containing streams against nitrogen-containing or argon-containing streams. Although modern air separation plants have molecular sieve adsorption beds to remove most of the contaminants from the air prior to separation by cryogenic distillation, any contaminants that slip through the adsorption beds tend to concentrate in the evaporating streams. These include inert contaminants such as carbon dioxide and nitrous oxide as well as reactive contaminants such as hydrocarbons. Fouling can lead to a loss of efficiency as well as the creation of potentially hazardous conditions if enough hydrocarbons accumulate in oxygen-containing passages. The use of textured fins can reduce the fouling tendency of plate-fin heat exchangers by improving their wetting characteristics so clearly manifest in terms of better heat transfer at high qualities.

Such large magnitudes of improvement (30–50% in Example 1, and 10–50% in Example 2), while trading-off nothing, are surprising and unexpected. These performance results achieved using textured surfaces were surprising and unexpected to Applicants and would be surprising and unexpected to other persons skilled in the art.

Based on the discussion, drawings, and examples above, persons skilled in the art will recognize that the present invention has many benefits and advantages over the plate-fin heat exchangers taught in the prior art. Some of these benefits and advantages are discussed further below.

Heat exchangers and dephlegmators designed in accordance with the present invention will be shorter and lighter than equivalent prior art devices for the same service. Also there will be reductions in the volume of the cold boxes that contain such devices in air separation processes, resulting in lower overall capital costs.

Alternatively, heat exchangers and dephlegmators designed in accordance with the present invention can yield lower operation costs at the same capital costs because of their higher efficiency.

Various advantageous combinations of the above two effects are also possible.

The present invention also can reduce the tendency of a plate-fin heat exchanger to foul, thereby improving its overall operating efficiency over time. This is especially applicable to plate-fin heat exchangers containing streams which evaporate while flowing in a generally downward direction.

The various embodiments of the present invention have been described with reference to the drawings and examples discussed above. However, it should be appreciated that variations and modifications may be made to those embodiments, drawings, and examples without departing from the spirit and scope of the invention as defined in the claims which follow.

What is claimed is:

1. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein at least a portion of the surface texture is in the form of horizontal striations.

2. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein at least a portion of the surface texture is applied at an angle relative to a horizontal position.

3. A plate-fin exchanger, wherein the angle is greater than about 0° and less than about 75°.

4. A plate-fin exchanger, wherein the angle is greater than about 0° and less than about 50°.

5. A plate-fin exchanger, comprising:

a first parting sheet;

a second parting sheet adjacent and substantially parallel to the first parting sheet; and least one corrugated fin disposed between the first parting sheet and the second parting sheet, the fin having at least one surface, wherein a surface texture is applied on at least a portion of the surface in the form of grooves or fluting, wherein at least a portion of the surface texture is applied in a crisscrossing manner.

6. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein the surface texture is in the form of a groove having a wavelength in a range of about 0.5 mm to about 5 mm.

7. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein the surface texture is in the form of a groove having a wavelength in a range of about 1 mm to about 3 mm.

8. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein the surface texture is in the form of a groove having an amplitude in a range of about 0.05 mm to about 0.75 mm.

9. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein the surface texture is in the form of a groove having an amplitude in a range of about 0.15 mm to about 0.50 mm.

10. A plate-fin exchanger, wherein the groove is at an angle relative to a horizontal position, said angle being greater than about 0° and less than about 75°.

11. A plate-fin exchange 6, wherein the groove is at an angle relative to a horizontal position, said angle being greater than about 0° and less than about 75°.

12. A plate-fin exchanger, comprising:

a first parting sheet;

a second parting sheet adjacent and substantially parallel to the first parting sheet; and at least one corrugated fin disposed between the first parting sheet and the second parting sheet, the fin having at least one surface, wherein a surface texture is applied on at least a portion of the surface in the form of grooves or fluting, wherein the surface texture is in the form of a groove having a wavelength in a range of about 0.5 mm to about 5 mm and an amplitude in a range of about 0.05 mm to about 0.75 mm.

13. A plate-fin exchanger, wherein the groove is at an angle relative to a horizontal position, said angle being greater than about 0° and less than about 75°.

14. A downflow reboiler having a generally parallelepipedal body formed by an assembly of substantially parallel vertically extending passages adapted to receive a first fluid introduced into a first group of passages and a second fluid introduced into a second group of passages, the passages in the second group of passages alternating in position with the passages in the first group of passages, the first group of passages having a plurality of fins disposed between neighboring parting sheets, the fins including hardway fins for fluid distribution of the first fluid and easyway heat transfer fins downstream of the hardway fins, the heat transfer fins forming one or more heat transfer sections with progressively decreasing surface area, at least one heat transfer fin in a first heat transfer section having at least one surface, the improvement comprising a surface texture applied on the at least one surface in the form of grooves or fluting.

15. A downflow reboiler according to claim 14 installed in a column of an air separation plant wherein a liquid oxygen-containing stream is passed through the first group of passages in parallel flow to a nitrogen-containing and/or argon-containing stream in the second group of passages.

16. A method for assembling a plate-fin exchanger, comprising the steps of:

providing two substantially parallel parting sheets and an elongated sheet;

forming a surface texture in the form of grooves or fluting on the elongated sheet;

corrugating the elongated sheet to form a fin having the surface texture thereon; and disposing the fin having the surface texture thereon between the parting sheets, wherein at least a portion of the surface texture is in the form of at least one groove having a wavelength in a range of about 0.5 mm to about 5 mm and an amplitude in a range of about 0.05 mm to about 0.75 mm, the at least one groove being at an angle relative to a horizontal position, said angle being greater than about 0° and less than about 75°.

* * * * *

UNITED STATES PATENT AND TRADEMARK OFFICE

CERTIFICATE OF CORRECTION

PATENT NO. : 6,834,515 B2
DATED : December 28, 2004
INVENTOR(S) : Swaminathan Sunder et al.

It is certified that error appears in the above-identified patent and that said Letters Patent is hereby corrected as shown below:

Column 10,
Line 65, add -- as in claim 2, -- after the word "exchanger"

Column 11,
Line 1, add -- as in claim 2, -- after the word "exchanger"
Line 9, add the word -- at -- before the word "least"

Column 12,
Line 1, add -- as in claim 6, -- after the word "exchanger"
Line 5, add -- as in claim 8, -- after the word "exchanger"
Line 23, add -- as in claim 12, -- after the word "exchanger"

Signed and Sealed this

Twelfth Day of April, 2005

JON W. DUDAS
*Director of the United States Patent and Trademark Office*